US006386516B1

(12) United States Patent
Lenders

(10) Patent No.: US 6,386,516 B1
(45) Date of Patent: May 14, 2002

(54) SHEAVE BLOCK WITH RETRACTABLE SHEAVE GUARDS

(75) Inventor: Bernardino Lenders, Friendswood, TX (US)

(73) Assignee: National-Oilwell L.P., Houston, TX (US)

( * ) Notice: Subject to any disclaimer, the term of this patent is extended or adjusted under 35 U.S.C. 154(b) by 0 days.

(21) Appl. No.: 09/032,206

(22) Filed: Feb. 27, 1998

(51) Int. Cl.[7] ..... B66D 3/08

(52) U.S. Cl. ..... 254/393; 254/403; 254/405; 254/404

(58) Field of Search ..... 254/393, 402, 254/403, 405, 411, 404, 412

(56) References Cited

U.S. PATENT DOCUMENTS

| | | | |
|---|---|---|---|
| 1,379,868 A | 5/1921 | Kelsey | |
| 1,577,403 A | 3/1926 | Timbs et al. | |
| 1,577,804 A | 3/1926 | Minor | |
| 2,650,403 A | 9/1953 | Taylor, Jr. | 24/242 |
| 2,762,606 A | 9/1956 | Morse | 254/190 |
| 2,800,300 A | 7/1957 | Johnson et al. | 254/194 |
| 3,905,581 A | 9/1975 | Chadwick, Jr. | 254/193 |

OTHER PUBLICATIONS

Declarations of Bernardino Lenders and Wesley C. Morrow with exhibits.

*Primary Examiner*—Donald P. Walsh
*Assistant Examiner*—Minh-Chau Pham
(74) *Attorney, Agent, or Firm*—Conley, Rose & Tayon, P.C.

(57) ABSTRACT

A sheave block for use with a wireline includes first and second opposing walls and a shaft extending therebetween. At least one grooved sheave is disposed on the shaft, each sheave being engageable with the wireline. At least one retractable sheave guard is movably connected to the first and second opposing walls and is moveable between open and closed positions, the open position allowing the wireline to be rereeved around at least one of the grooved sheaves without entirely removing the wireline from the sheave block.

69 Claims, 16 Drawing Sheets

SHEAVE BLOCK WITH RETRACTABLE SHEAVE GUARDS

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates generally to sheave blocks, such as traveling blocks and crane, or boom, blocks. More particularly, the invention relates to a sheave block having retractable sheave guards.

BACKGROUND OF THE INVENTION

A "sheave block" is an apparatus used in systems for heavy lifting and other weight bearing operations. The sheave block employs numerous "sheaves," each sheave having a groove in its outer circumference within which a wire rope, or wireline, may be supported. The sheaves are supported and independently rotatable on a common shaft that extends between opposing side plates, or walls, of the sheave block. Each pass (or loop) of the wireline around a sheave in the sheave block is referred to as a "reeve." By passing the wireline around more than one sheave, thus having numerous reeves, the lifting force of the wireline is multiplied.

Some of the most common forms of sheave blocks include traveling blocks used during oil and gas drilling, crane or boom blocks used on large cranes for various heavy lifting operations and pulley blocks. Lifting systems use a power source to create tension in the wireline, allowing the load to be raised and lowered at a certain velocity. Typically, the power source is capable of supplying power within a certain range; thus the power supply is not unlimited.

In certain instances involving the use of sheave blocks, such as in drilling operations, it is desirable to adjust the weight bearing capability of the wireline as the weight of the load changes so as to maintain, or improve, operational efficiency. A well-known method of adjusting the weight bearing capability of a sheave block system is to change the number of reeves of the wireline. This is know as "rereeving" the wireline. By increasing the number of reeves, the lifting capacity of the system will be increased without additional line tension (or power). At the same time, however, the greater the number of reeves, the slower the lifting operations become at a constant wireline pulling velocity. Thus, while it is sometimes preferred or necessary to increase the number of reeves to lift heavy loads within available power source limits, it is generally desirable to use the smallest number of reeves to lessen the time required for lifting and, thus, to have more time-efficient operation.

During various stages of drilling operations, such as when a heavy drilling string extending deep into the bore hole must be lowered or raised, it is desirable to have a greater number of reeves through the travelling (sheave) block of the drilling rig lifting system to enable the system to support the increased load. At other times, the existence of a relatively light load allows the weight bearing wireline to be reeved over a small number of sheaves in the travelling block, enabling time-efficient operation. The ability to save time by rereeving the travelling block during drilling operations can result in significant cost savings. For example, thousands of dollars per day may be saved when rereeving is used on an offshore drilling rig, where the cost for operating the rig may range between $30,000–$150,000 per day.

Rereeving a sheave block typically involves various design considerations. For example, the sheave block must enable access to the sheaves within the sheave block to allow rereeving. Typically, access is gained by removing or opening safety guards extending at least partially around the sheaves between the side plates. The safety guards are included in the sheave block to prevent the intrusion or entanglement of objects into the sheave block during use and to prevent the wireline from jumping out of the sheave block.

The sheave block design should also allow positioning of the wireline within the sheave block in a load balanced pattern, such as in the center of the sheave block, to assist in maintaining system stability. At the same time, however, it is desirable to minimize the bulkiness and size of the sheave block to enhance handling and installation. Furthermore, because rereeving requires the interruption of the primary operations being performed at the work site, it is highly desirable to minimize the time necessary for rereeving.

Yet another concern is safety. The sheave block should be designed so that the wireline may be rereeved without increasing the risk of equipment damage or human injury.

Sheave block designs that have been proposed in the past have various disadvantages. For example, the increased size and bulkiness of the sheave block disclosed in U.S. Pat. No. 1,577,804 increases its difficulty in use and handling. For another example, the sheave block disclosed in U.S. Pat. No. 2,800,300 must be laid on its side to be rereeved. Rereeving with this block design thus requires substantial time and handling.

Thus, there remains a need for a sheave block that allows speedy rereeving without increasing the risk of safety hazards during rereeving. Especially well received would be a sheave block having sheave guards that generally shield the circumference of the sheaves during lifting operations; that are easily retractable to allow sufficient access to the sheaves for rereeving and positioning of the wireline within the sheave block in a load balanced pattern; that allow rereeving without having to entirely remove the wireline from the sheave block; and that do not add significant mass or size to the sheave block. Preferably, the device should allow the sheave block to perform in a conventional manner. Ideally, existing sheave blocks could be retrofitted, or otherwise adopted, with the new sheave block design.

BRIEF SUMMARY OF THE INVENTION

In accordance with the present invention, there is provided a sheave block for use with a wireline that includes first and second opposing walls and a shaft extending there between. At least one grooved sheave is disposed on the shaft, each grooved sheave being engageable with the wireline. At least one retractable sheave guard is movably connected to the first and second opposing walls and is moveable between open and closed positions, the open position allowing the wireline to be rereeved around at least one of the sheaves without entirely removing the wireline from the sheave block. The retractable sheave guards may be movable between open and closed positions while the wireline is engaged with at least one of the grooved sheaves. Further, the retractable sheave guards may be moveable between open and closed positions without moving the retractable sheave guards upwardly. At least one of the retractable sheave guards may be pivotably moveable between open and closed positions.

The sheave block may include at least one releasable lock capable of retaining at least one of the retractable sheave guards in its closed position. In one embodiment, the lock includes at least one cam rod. At least one of the sheave guards may include a plurality of fingers and a plurality of wireline passages enabling the guard to be movable between open and closed positions while the wireline is engaged with at least one of the sheaves. The fingers may include eyelets engageable with the releasable lock.

At least two of the sheave guards may be connected and may be cooperatively moveable between open and closed positions. At least one coupler connecting at least two of the sheave guards may be included. In one embodiment, the coupler includes at least one link. The sheave block may include at least one sheave guard stop member capable of supporting at least one of the sheave guards in its open position.

In one embodiment, a first sheave guard includes first and second ends, the first sheave guard being moveable downwardly relative to the sheaves from its closed position to its open position. Further, at least one of the first and second opposing walls may include a guide slot, the first sheave guard including at least one guide member moveable upwardly and downwardly within the guide slot. The guide member may be rotatable and include a guide portion having a non-circular cross-section, the guide portion being selectively moveable upwardly and downwardly within the guide slot. The first and second ends of the first sheave guard may be independently moveable upwardly and downwardly relative to the sheaves.

A second sheave guard may be disposed adjacent to the first end of the first sheave guard, and a third sheave guard may be disposed adjacent to the second end of the first sheave guard. The first guard may be connected to the second and third guards. At least one coupler connecting the first guard to the second and third guards may be included. In one embodiment, the coupler includes at least one link. The first, second and third guards may be cooperatively or independently moveable between open and closed positions.

At least one releasable lock capable of retaining the first, second and third retractable sheave guards in closed positions may be included, and the lock may include at least one cam rod. In one embodiment, the releasable lock includes a first rotatable cam rod engageable with the second sheave guard, and a second rotatable cam rod engageable with the third sheave guard. Each of the second and third retractable sheave guards may include a plurality of fingers and a plurality of wireline passages enabling the sheave guards to be movable between open and closed positions while the wireline is engaged with at least one of the sheaves. The second and third sheave guards may be pivotably movable between open and closed positions.

In another embodiment, a sheave block having a housing that contains a plurality of sheaves engageable with a wireline includes first and second side sheave guards and a lower sheave guard, each guard being moveably connected with the housing. The lower sheave guard is disposed between the first and second side sheave guards. Each sheave guard is moveable between an open and a closed position, wherein at least a portion of the guard is farther from the sheaves when the guard is in the open position than when it is in the closed position.

The sheave guards may be movable between open and closed positions while the wireline is engaged with at least one of the sheaves. Further, the sheave guards may be moveable between open and closed positions without moving the sheave guards upwardly. The lower sheave guard may include first and second ends, and may be moveable downwardly relative to the sheaves from its closed position to its open position. The housing may include at least two guide slots, the lower sheave guard including at least two guide members, each guide member being moveable upwardly and downwardly within one of the guide slots. Each guide member may be rotatable and include a guide portion having a non-circular cross-section, the guide portion being selectively moveable upwardly and downwardly within one of the guide slots.

The lower sheave guard may be connected to the first and second side sheave guards. At least one coupler connecting the lower sheave guard to the first and second side sheave guards may be included. In one embodiment, the coupler includes at least one link. The first and second side sheave guards and the lower sheave guard may be cooperatively or independently moveable between open and closed positions.

At least one releasable lock capable of retaining the sheave guards in their closed positions may be included, and may include at least one cam rod. The releasable lock may include a first rotatable cam rod engageable with the first side sheave guard, and a second rotatable cam rod engageable with the second side sheave guard. Each of the first and second side sheave guards may include a plurality of fingers and a plurality of wireline passages enabling the sheave guards to be movable between open and closed positions while the wireline is engaged with at least one of the sheaves. The sheave block may include at least one sheave guard stop member capable of supporting at least one of the sheave guards in its open position.

In another embodiment, a sheave block for use with a wireline includes first and second opposing walls, a shaft extending between the walls and having at least one grooved sheave disposed thereon. Each grooved sheave is engageable with the wireline. A plurality of retractable sheave guards movably connected to the opposing walls is included. This embodiment also includes means for movably connecting the retractable sheave guards to the walls to allow the sheave guards to be moved between open and closed positions while the wireline is engaged over at least one of the sheaves, the open positions allowing the wireline to be rereeved around at least one of the sheaves without entirely removing the wireline from the sheave block. Also included is means for guiding the retractable sheave guards between open and closed positions. The sheave block may further include means for connecting the retractable sheave guards together.

Further in accordance with the present invention, a method of rereeving a wireline through a sheave block without having to completely remove the wireline from the sheave block is included. The sheave block includes a plurality of sheaves, at least one retractable sheave guard movable between open and closed position and at least one releasable sheave guard lock releasably securing the retractable sheave guard in the closed position. The wireline passes through the sheave block and is reeved over at least one sheave in the sheave block. The method includes releasing at least one sheave guard lock, moving at least one retractable sheave guard into an open position without disturbing the wireline passing over at least one sheave in the sheave block, moving a free end of the wireline through the sheave block to change the number of reeves of the wireline over the sheaves in the sheave block, moving the retractable sheave guard(s) into a closed position, and locking the sheave guard lock(s). The method may also include moving at least one reeve of the wireline from one sheave to another sheave in the sheave block.

Thus, the present invention includes the use of sheave guards that can safely and easily be moved between opened and closed positions to enable efficient and quick rereeving and positioning of the wireline in a load balanced pattern in the sheave block without having to remove the entire wireline from the sheave block. The present invention facilitates rereeving without the assembly or disassembly of numerous complex parts. Further, the present invention may be used with various types of sheave blocks, or mechanism, having numerous sheaves, such as traveling blocks and crane blocks, without significantly adding to the size of the block.

Accordingly, the present invention has advantages which enable it to substantially advance the technology associated with sheave block devices and methods of rereeving. The characteristics and advantages of the present invention described above as well as additional features and benefits will be readily apparent to those skilled in the art upon reading the following detailed description and referring to the accompanying drawings.

BRIEF DESCRIPTION OF THE DRAWINGS

For a detailed description of the preferred embodiments of the invention, reference will now be made to the accompanying drawings wherein.

DETAILED DESCRIPTION OF PREFERRED EMBODIMENTS

Figure 1:
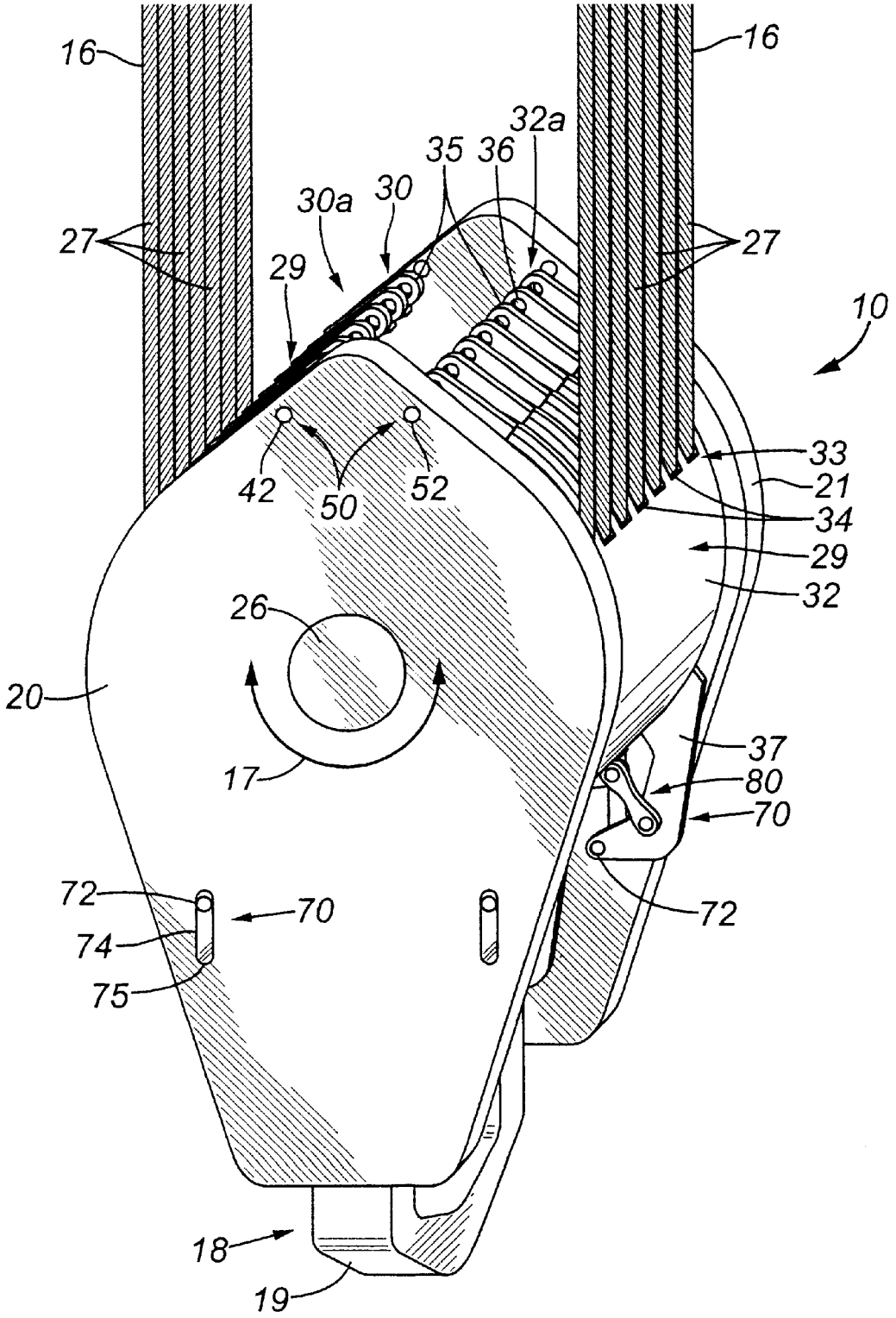
FIG. 1 is an isometric view of a first embodiment of a sheave block made in accordance with the present invention.

The presently preferred embodiments of the invention are shown in the above-identified figures and described in detail below. In illustrating and describing these embodiments, like or identical reference numerals are used to identify common or similar elements. The figures are not necessarily to scale, and certain features and certain views of the figures may be shown exaggerated in scale or in schematic form in the interest of clarity and conciseness.

Figure 2:
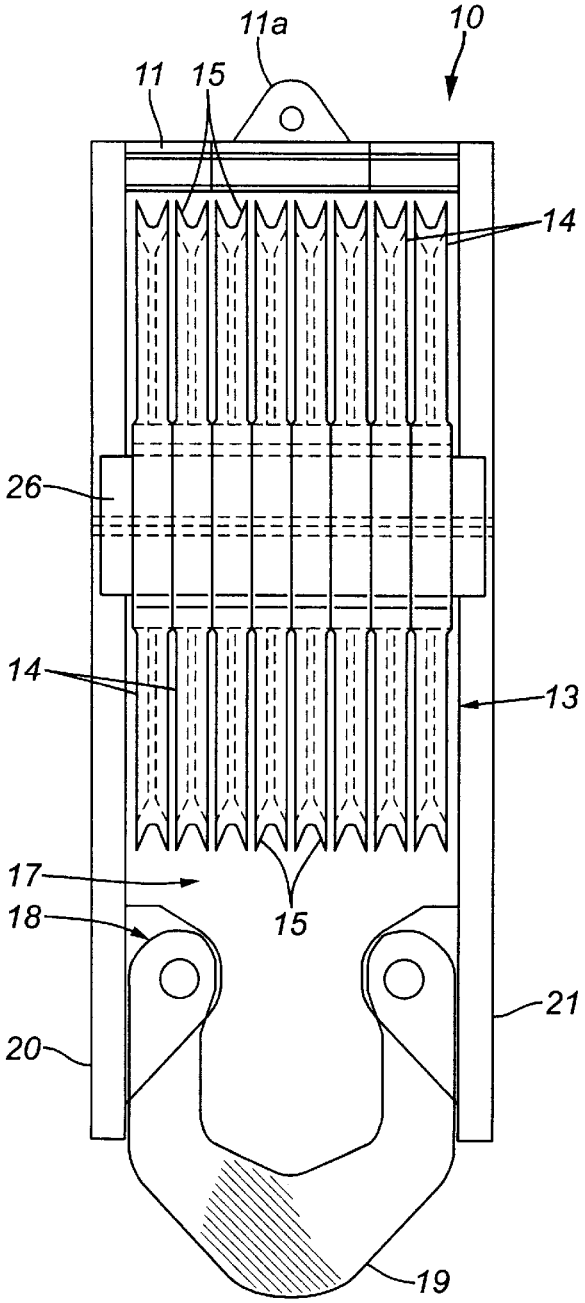
FIG. 2 is a side view of the sheave block of FIG. 1 with the addition of a cap member and cap eye, and showing a plurality of sheaves inside the sheave block.

Referring initially to FIGS. 1 and 2, there is shown a sheave block 10 that is used as a traveling block. It should be understood that the present invention, as will be described below, is not limited to use with traveling blocks, but may be used with any type of sheave block (or pulley block) that contains more than one sheave, such as a crane or boom block. The block 10 includes a pair of opposing side plates or walls 20, 21 and a shaft 26 extending between the walls 20, 21. Numerous grooved pulleys, or sheaves 14 are rotatably disposed on the shaft 26 between the walls 20, 21. The sheaves 14, having circumferential grooves 15, are associated with conventional bearings 25 (FIG. 2), mounted side by side on the shaft 26 and allowed to independently rotate relative to the shaft 26. Any desirable number of sheaves 14 compatible for use with the present invention may by included. The walls 20, 21 and sheaves 14 generally define a semi-circular passageway 17 for passage therethrough of a wireline 16 engageable with one or more of the sheaves 14.

The block 10 also includes a coupling mechanism 18, such as a shackle 19, for releasable connection of the block 10 with conventional accessories, such as a hook (not shown), and with an object or objects (not shown) being lifted. At the top of the block 10 is a cap member 11 (FIG. 2) rigidly connected between the walls 20, 21. The cap member 11 includes a cap eye 11*a*, which serves as a releasable connection point for handling the block 10. All of the above-described features and operation are known in the art.

Figure 2A:
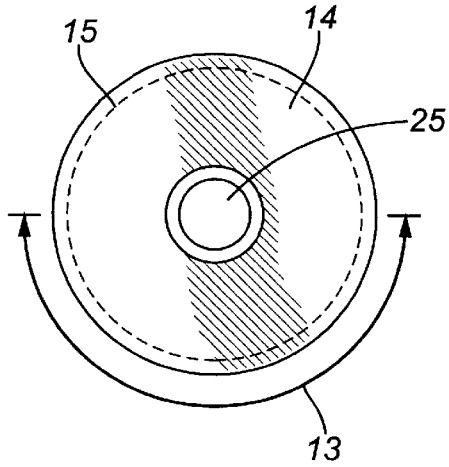
FIG. 2*a* is a view of a sheave of FIG. 2 viewed along the sheave's axis of rotation.
Figure 3:
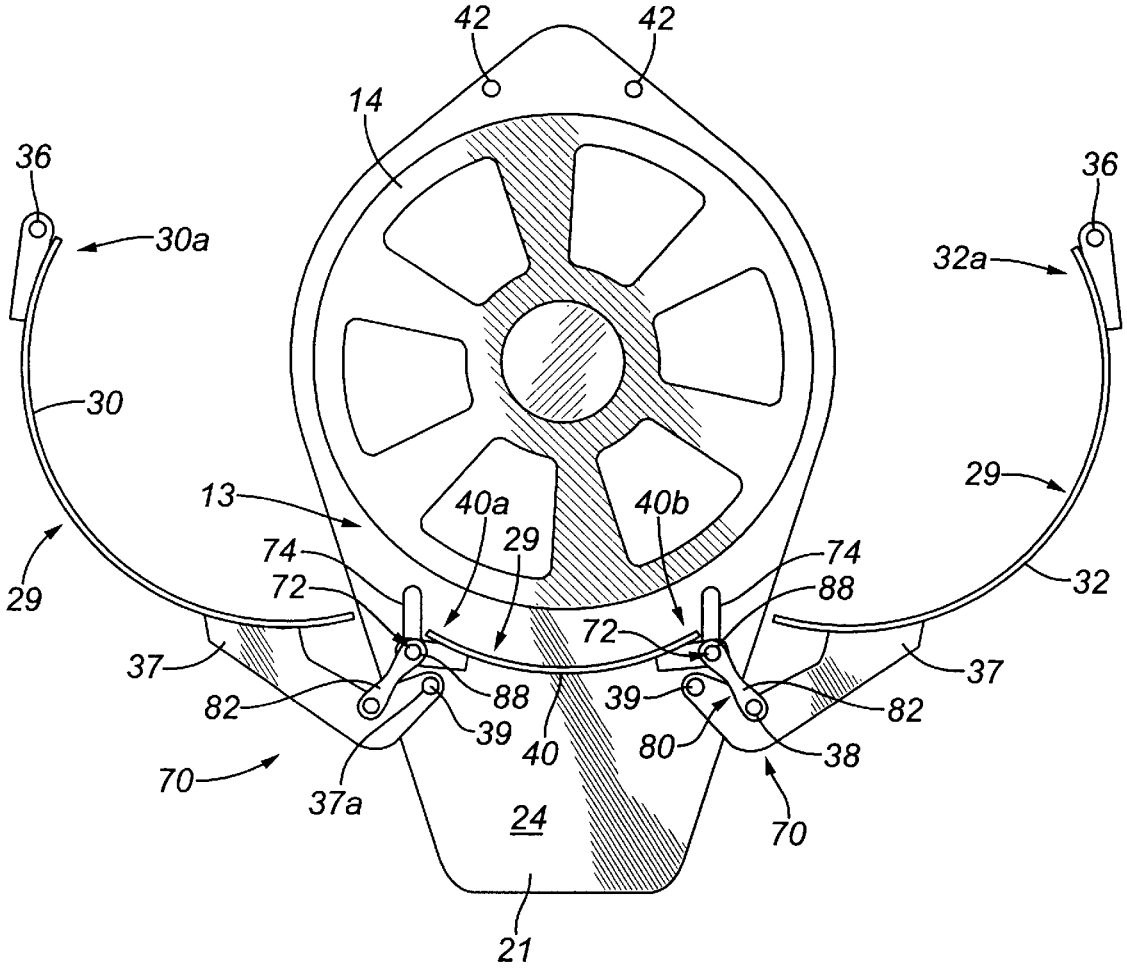
FIG. 3 is an end view of the sheave block of FIG. 1 with an end wall removed showing the retractable sheave guards in their open positions.

Now referring to FIGS. 1 and 3, rereeving a wireline 16 through sheave block 10 generally requires access to at least the lower half 13 (FIG. 2*a*) of the outer circumference of the sheaves 14. In accordance with the present invention, the block 10 includes two or more retractable sheave guards 29 disposed between the walls 20, 21. The retractable sheave guards 29 are each moveable between open and closed positions relative to the sheaves 14. The term "closed position" as used herein means fixed, or secured, in position between the walls of the sheave block, generally providing a shield around at least the lower half of the circumference of the sheaves and being too close to the sheaves to allow rereeving. The term "open position" as used herein means that at least a portion of the retractable sheave guard is farther from the sheaves than when the guard is in a closed position, allowing access to the sheaves for rereeving.

Figure 4:
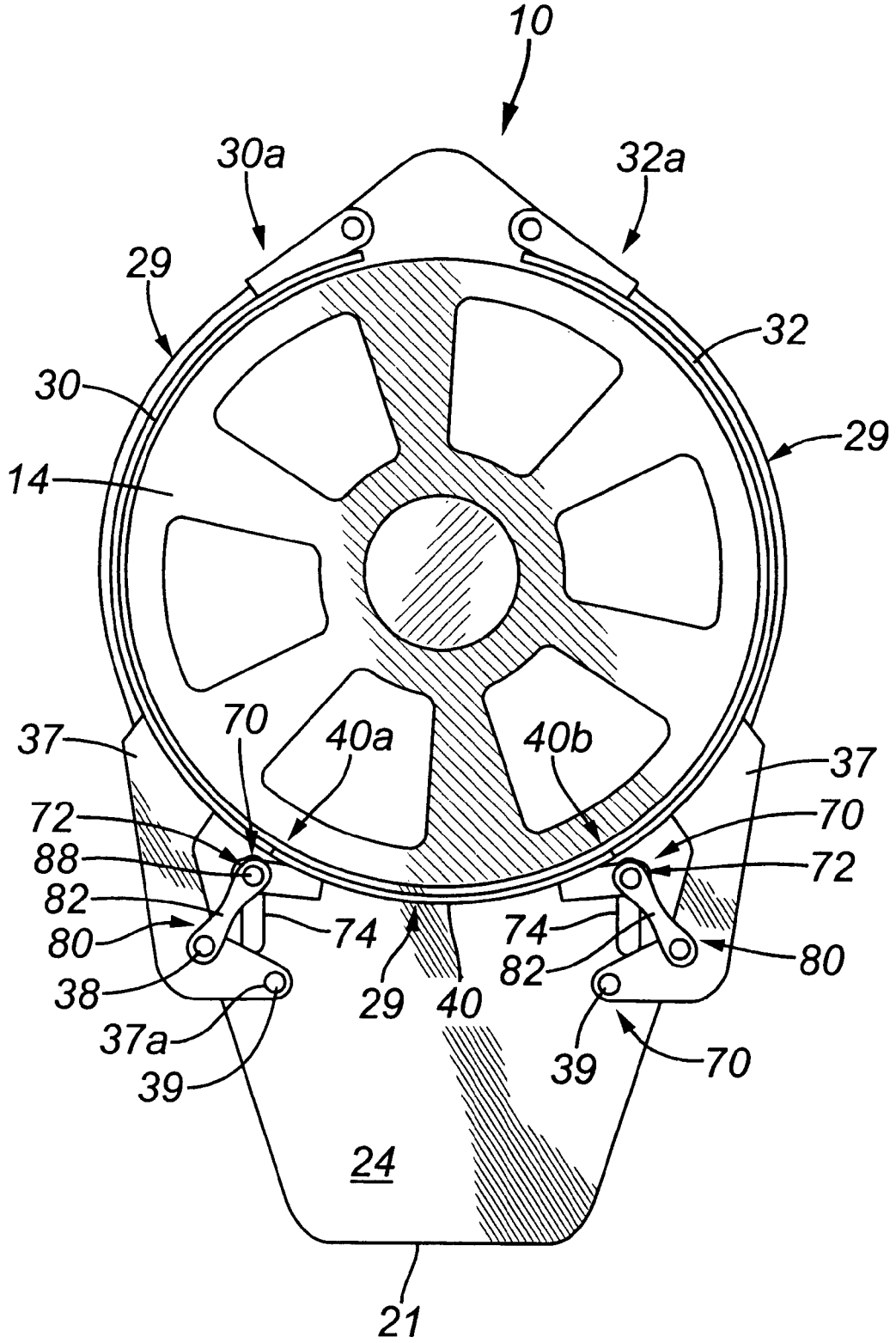
FIG. 4 is an end view of the sheave block of FIG. 1 with an end wall removed showing the retractable sheave guards in their closed positions.

The preferred embodiment of FIGS. 3 and 4, for example, has three retractable sheave guards 29, including a pair of opposing retractable side sheave guards 30, 32 and a lower retractable sheave guard 40. The retractable side sheave guards 30 and 32 are curved members that are releasable at their upper ends 30*a*, 32*a*, respectively, from the walls 20, 21, allowing each to move between a closed position (FIG. 4) and an open position (FIG. 3). The retractable lower sheave guard 40 is a curved member disposed between the side guards 30, 32, and is releasably moveable downwardly relative to the sheaves 14 from a closed position (FIG. 4) to an open position (FIG. 3). It should be understood, however, that while the following description of the invention is made, in part, with respect to a preferred embodiment having three retractable sheave guards, the invention is not so limited; any number of retractable sheave guards taking any suitable shape and configuration operable in accordance with the present invention may be used. For example, a configuration having only two retractable sheave guards and capable of operation in accordance with the present invention may be used.

Still referring to FIGS. 3 and 4, the retractable sheave guards 29 are moveable between open and closed positions with the use of one or more retractors 70. The retractors 70 can take any form and configuration suitable for such purpose, such as hinges, levers, pins, pivots, or a combination thereof. Furthermore, any suitable quantity of retractors can be used. In the preferred embodiment (FIGS. 3, 4), the retractors 70 include a pair of pins 39 about which the side sheave guards 30, 32 pivot. Each pin 39 is connected between the walls 20, 21 spaced below the sheaves 14, and extends through a bore 37*a* formed in a curved lug portion 37 of one of the side guards 30, 32. The curved lug portions 37 of the side guards 30, 32 are rotatable about the pins 39. Thus, as the upper ends 30*a*, 32*a* of the side guards 30, 32 are released from the sheave block 10, the side guards 30, 32 are pivotable about the pins 39 between their open and closed positions.

Referring to FIGS. 1, 3 and 4, retractors 70 are preferably also included for the lower guard 40. The retractors 70 for the lower guard 40 includes guide shafts, or pins, 72 extending laterally from the lower guard 40 and engageable with guide slots 74 in walls 20, 21. The guide pins 72 are moveable upwardly and downwardly within corresponding guide slots 74. The guide slots 74 define the range of motion of the guide pins 72 and the lower guard 40 between open and closed positions. When the lower guard 40 is released from its closed position, it moves downwardly as the guide pins 72 move downwardly within the guide slots 74. Preferably, when the guide pins 72 reach the bottom 75 (FIG. 1) of the guide slots 74, the guide slots 74 hold, or support, the lower guard 40 in its open position, ensuring no further downward movement of the lower guard 40.

Again referring to FIG. 1, the guards 29 are secured in their closed positions with one or more releasable locks 50. Any suitable form or configuration of releasable lock 50 may be used that enables securing the guards 29 in their closed positions and allows their release therefrom for movement into the open position. For example, the lock 50 may be a bolt 52 (FIG. 1), a cam rod 54 (FIG. 5*a*) or a spring-loaded pin (not shown). Further, depending on the particular configuration of the guards 29, different types of locks 50 may be used for different guards 29, and a separate lock 50 may not be necessary for each guard 29.

In the preferred embodiment of FIGS. 1 and 3, the locks 50 are bolts 52 that releasably connect the side guards 30 and 32 to the walls 20, 21. Each bolt 52 extends through upper bores 42 in the walls 20, 21 and corresponding eyelets 36 in one of the guards 30, 32. No additional locks 50 are used with the lower guard 40 because the position of the lower guard 40 is controlled by the position and movement of the side guards 30, 32, as will be described below.

Referring again to FIGS. 3 and 4, the guards 29 may be interconnected with one another for cooperative movement between their open and closed positions with the use of one or more couplers 80. The couplers 80 preferably include a link 82 connecting each side guard 30, 32 to the lower guard 40. One end of the first link 82 is connected to the left side 40*a* of the lower guard 40 with a pivot pin 88 about which the link 82 is rotatable. It should be noted that the guide pin 72 described above may also serve as pin 88. The other end of the first link 82 is connected to the curved lug portion 37 of the side guard 30 with a pivot pin 38 about which the link 82 is rotatable. The pivot pins 38 are particularly positioned on the curved lug portions 37 of the guards 30, 32 to enable the desired ranges of motions of guards 30, 32 and 40 as they cooperatively move between open and closed positions. Similarly, the second link 82 is connected with the right side 40*b* of the lower guard 40 and the side guard 32. The links 82 allow all three guards 29 to move cooperatively. For example, the opening of side guards 30, 32 (FIG. 3) draws the links 82 downwardly, forcing the guide pins 72 to move downwardly in the guide slots 74, thus causing the lower guard 40 to move downwardly. Likewise, the closing movement of the side guards 30, 32 (FIG. 4) causes the upward movement of the links 82, guide pins 72 and lower guard 40. Because the lower guard 40 is retained in its closed position when the side guards 30, 32 are retained in their closed positions, there is no requirement for any releasable locks 50 used directly with the lower guard 40. Further, when the guide pins 72 of the lower guard 40 reach the bottom 75 (FIG. 1) of the guide slots 74, the side guards 30, 32 will be held in their open positions by links 82 (FIG. 3). Thus, all three guards 30, 32, 40 are supported and maintained in their open positions, ensuring no further opening movement of the guards 30, 32, 40, thereby providing safety benefits.

Figure 5:
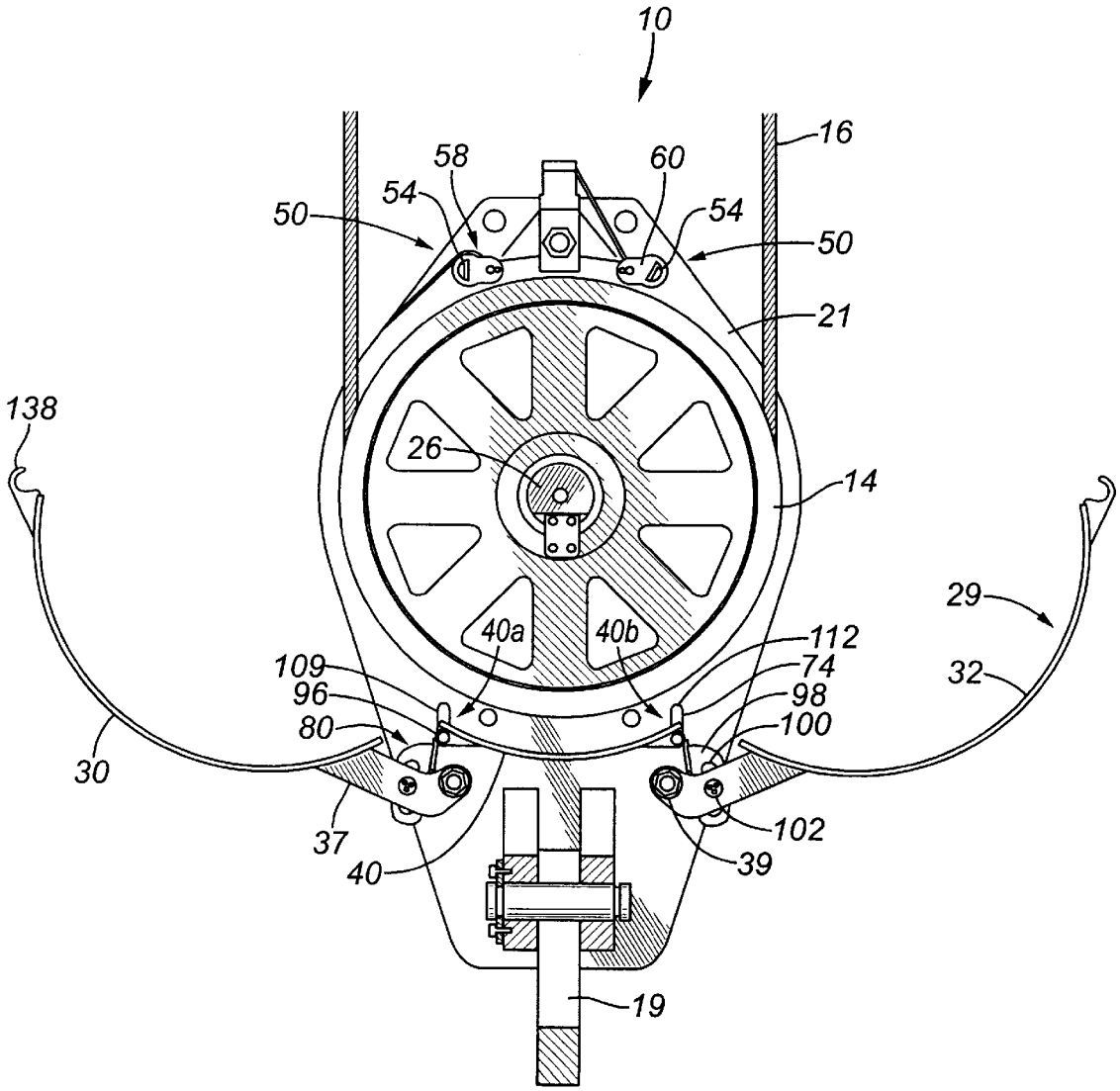
FIG. 5 is an end view of a second embodiment of a sheave block made in accordance with the present invention with an end wall removed and showing the retractable sheave guards in their open positions.
Figure 5A:
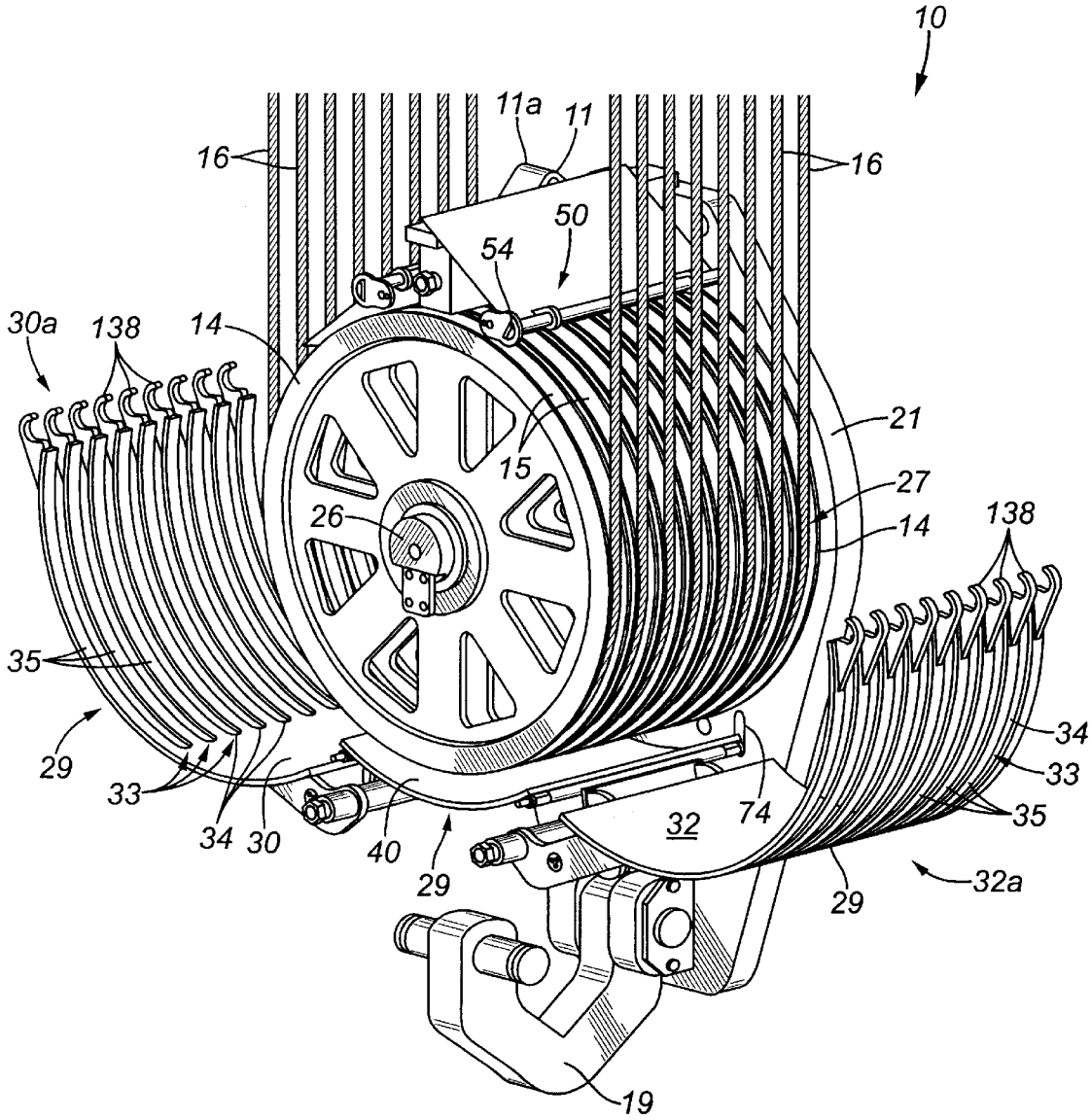
FIG. 5*a* is an isometric view of the embodiment of FIG. 5.

Now referring to the embodiments of FIGS. 1 and 5*a*, the side guards 30, 32 preferably include wireline passages 33, such as slots 34, through which the wireline 16 may pass. Each wireline slot 34 has a width sufficient to allow passage of the wireline 16 therethrough, and is aligned with one of the sheaves 14 to allow engagement of the wireline 16 with the corresponding sheave groove 15. The illustrated exemplary slots 34 are formed between guard fingers 35 that are integral to the guards 30, 32 and extend to the upper ends 30*a*, 32*a* of the guards 30, 32, respectively. The quantity of wireline passages 33 and fingers 35 may be selected to correspond with the total number of sheaves 14 contained in the block 10, or otherwise as desired. Thus, the retractable sheave guards 29 may be moved between open and closed positions without interfering with a wireline 16 engaging the sheaves 15, enabling rereeving without having to remove the wireline 16 from the block 10.

Figure 6:
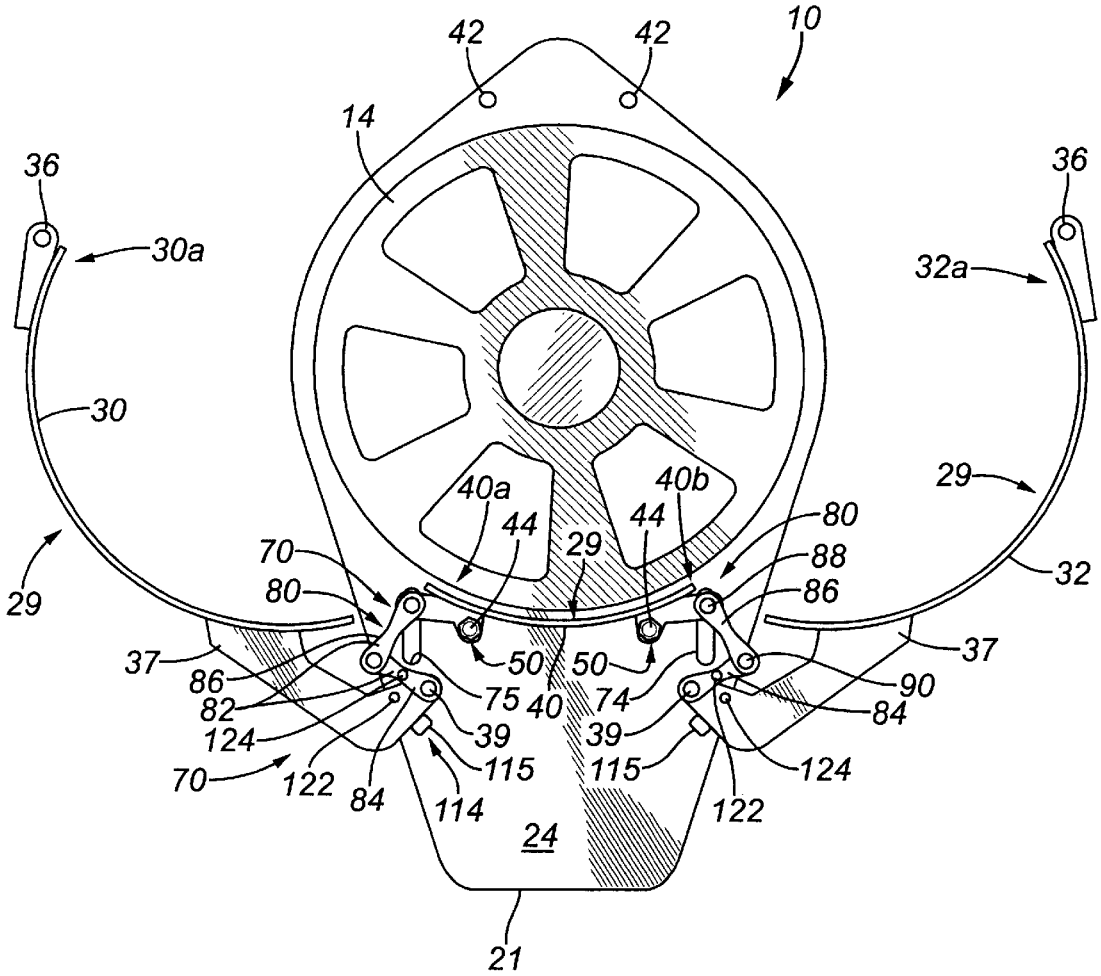
FIG. 6 is an end view of a third embodiment of a sheave block made in accordance with the present invention with an end wall removed and showing the retractable sheave guards in their open positions.
Figure 7:
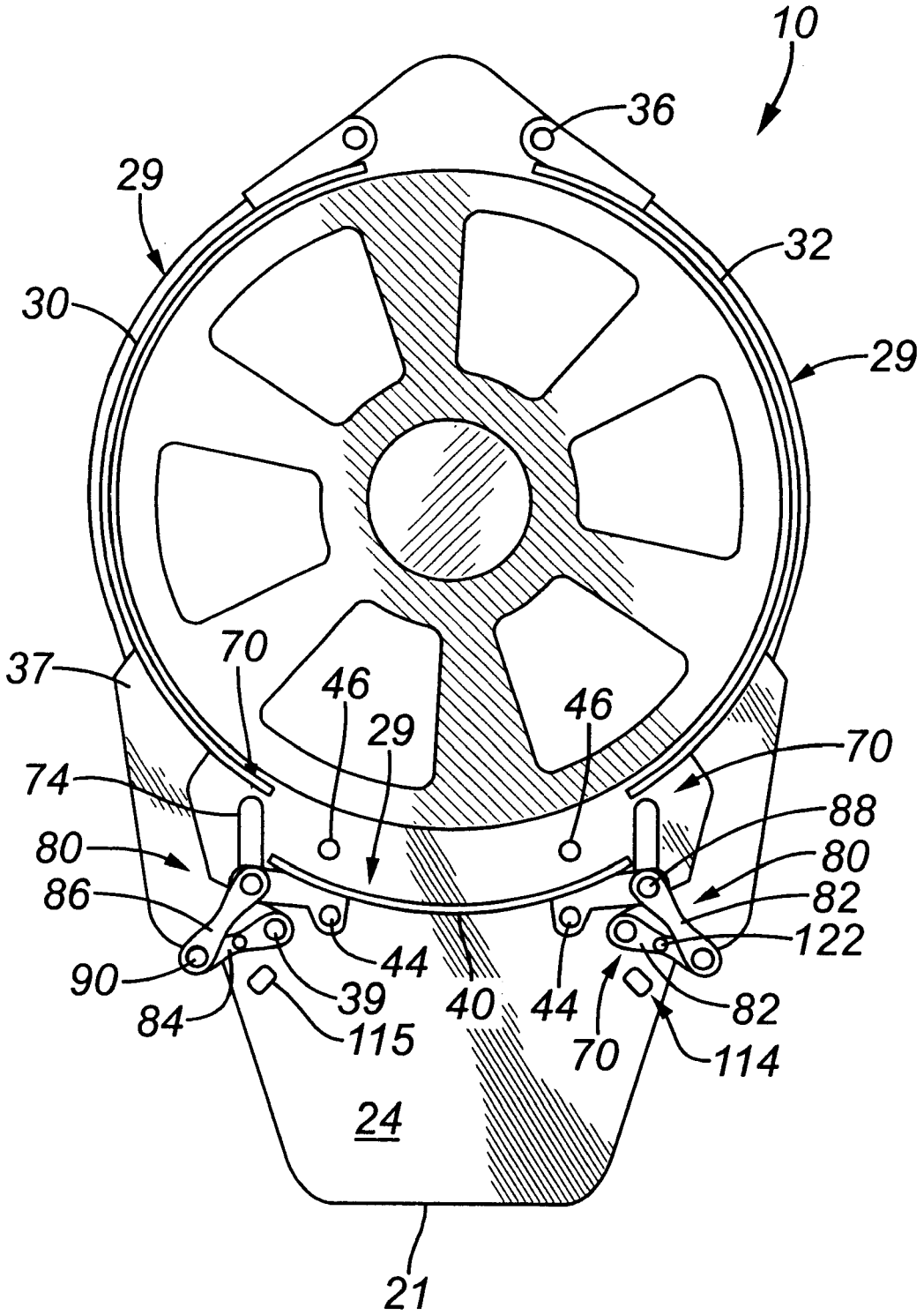
FIG. 7 is an end view of the sheave block of FIG. 6 with an end wall removed and showing the retractable sheave guards in their closed positions and the lower guard in its open position.

In an alternate embodiment, as shown in FIGS. 6 and 7, the guards 29 may be interconnected to allow selective cooperative or independent movement. In this embodiment, the couplers 80 include a pair of links 82 connecting each side guard 30, 32 with the lower guard 40. The first pair of links 82 connects side guard 30 with the left side 40*a* of lower guard 40, while the second pair of links 82 connects side guard 32 with the right side 40*b* of lower guard 40. In each instance, an upper link 86 is pivotably connected to the lower guard 40 with pivot pin 88, similarly as described above with respect to FIGS. 3 and 4, and a lower link 84 is pivotably connected to the corresponding side guard 30 or 32 with pivot pin 39. Each upper link 86 is connected to its corresponding lower link 84 with another pivot pin 90, about which each link is rotatable. The pivoting movement of the links 84, 86 allows each of the guards 30, 32 and 40 to be movable independently of the other guards 30, 32 or 40.

Figure 8:
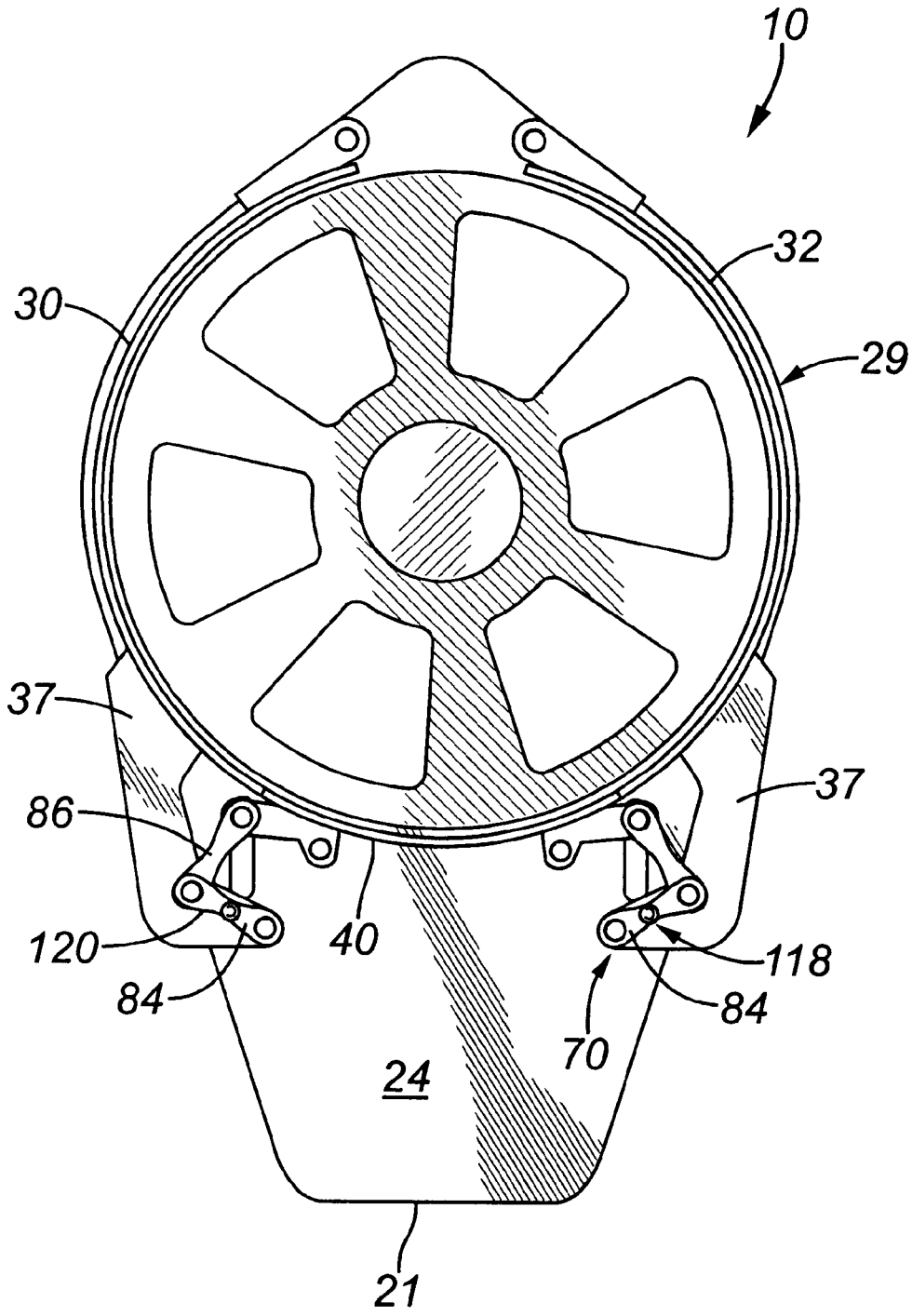
FIG. 8 shows an end view of the sheave block of FIG. 7 having the removable connectors of the couplers engaged.
Figure 9:
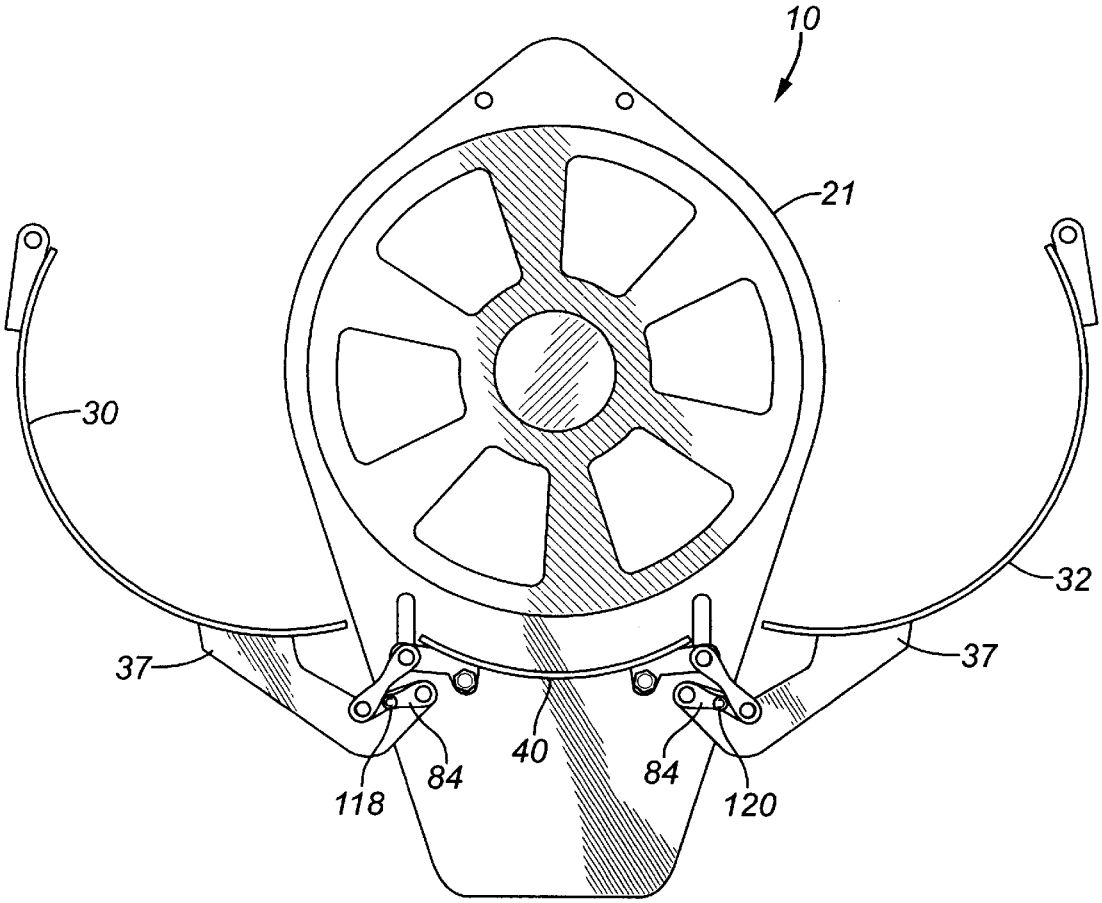
FIG. 9 shows an end view of the sheave block of FIG. 6 having the removable connectors of the couplers engaged.

The couplers 80 of this embodiment, however, are equipped with a removable connector 118, as shown in FIGS. 8. and 9, for connecting each lower link 84 to the adjacent side guard curved lug portion 37, which enables cooperative movement of the guards 30, 32 and 40. The connector 118 can take any suitable form, such as a bolt 120, or pin (not shown). Each bolt 120 extends through a hole 122 (FIG. 6) in the lower link 84 and a hole 124 in the adjacent curved lug 37. When each set of holes 122 and 124 are aligned and held together with a connector 118 (FIG. 8, 9), the independent movement of the lower links 84 relative to the corresponding side guards 30, 32 is eliminated. As a result, the guards 30, 32, 40 move cooperatively, similarly as described above with respect to FIGS. 3 and 4. Disengagement of the connectors 118 will allow independent movement of the guards 30, 32, 40, as described above.

Figure 10:
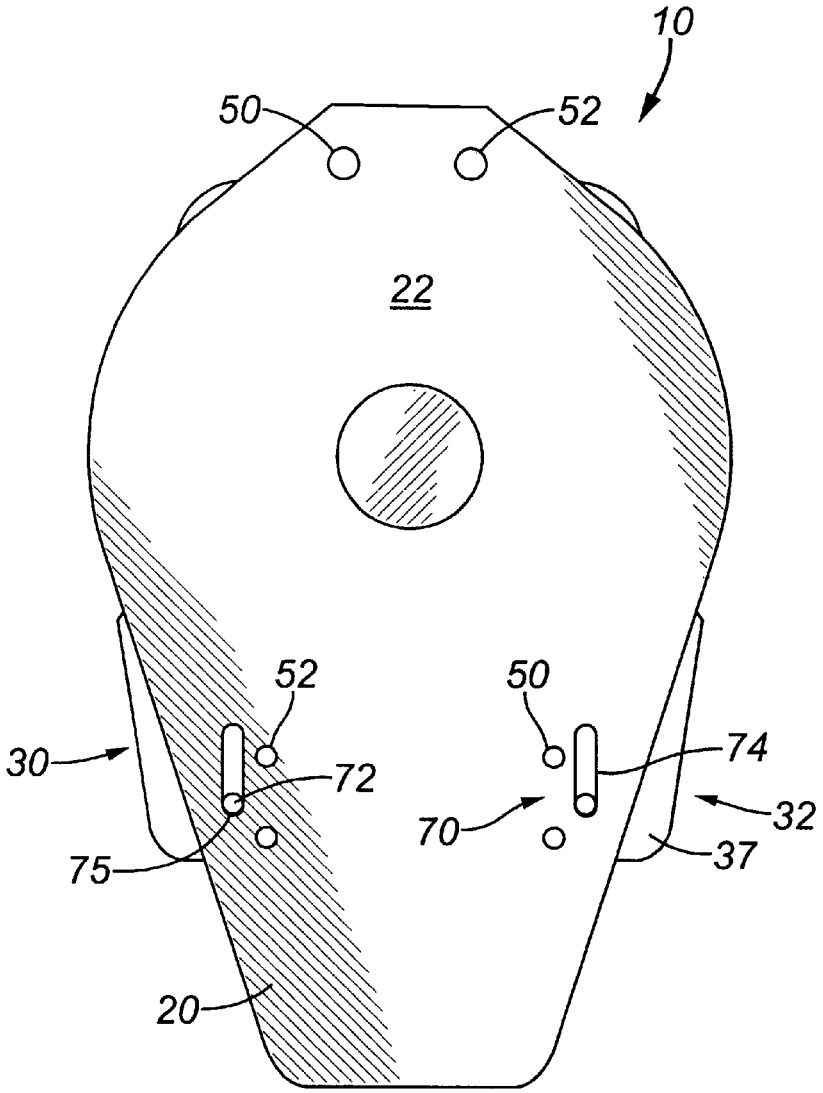
FIG. 10 is an end view of the sheave block of FIG. 7.

In this embodiment, a separate lock 50 is useful with the lower guard 40 when the sheave block 10 is configured to allow the lower guard 40 to move independently from the side guards 30, 32. The lower guard lock 50 shown in FIGS. 6 and 10 includes a pair of bolts 52 connecting the lower guard 40 to the walls 20, 21, each bolt 52 extending through a hole 44 in the lower guard 40 and a corresponding bore 46 in one or both walls 20, 21. Each bolt 52 may be secured in locked position with a mateable member, such as a nut, or cap (not shown). Only upon the release of the lower guard lock 50 will the lower guard 40 be moveable downwardly, or opened. It should be noted that with the engagement of connectors 118 and use of locks 50 with the lower guard 40, the guards 30, 32 and 40 can be opened and closed independently of one another, or in any combination.

The sheave block 10 may include one or more side sheave guard stop members 114 limiting the opening movement of the side guards 30, 32, as shown, for example, in FIGS. 6 and 7. The stop member 114 can take any suitable form and configuration, so long as it is capable of supporting the weight of the side guards 30, 32 and holding the side guards 30, 32 in their open positions, such as a hard metal protrusion 115 welded onto the inside surface 24 one or both plates 20, 21. It should be understood, however, that the use of stop members 114 is not necessary for operation of the present invention.

In yet another embodiment, as shown in FIGS. 5 and 5*a*, the side guard lock 50 includes a pair of rotatable elongated cam rods 54. The cam rods 54 (FIG. 11) are rotatably mounted between the walls 20, 21 of the sheave block 10 with any suitable conventional technique. For example, each cam rod 54 may be retained at its ends 59*a*, 59*b* in bores 42 (FIG. 12) extending through each wall 20, 21. Between its ends, each cam rod 54 is mateable with a series of C-shaped eyelets 138 (FIG. 5*a*) disposed at the upper end 30*a*, 32*a* of side guards 30, 32, respectively.

Figure 11:
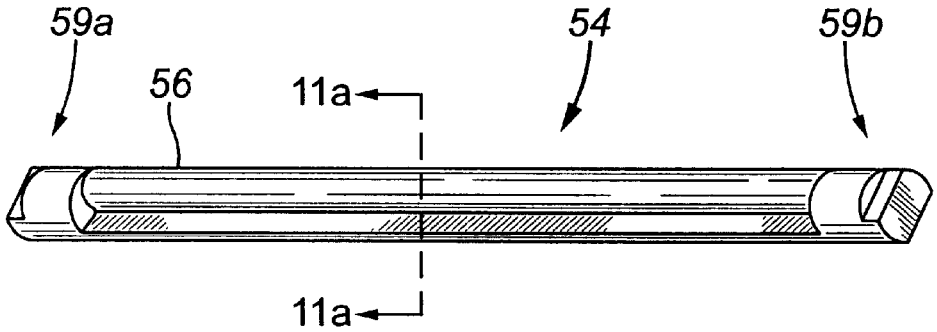
FIG. 11 is an isometric view of the cam rod sheave guard lock of FIG. 5.
Figure 11A:
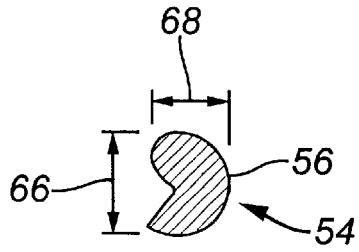
FIG. 11*a* is a cross-sectional view of the cam rod sheave guard lock of FIG. 11 taken along line 11*a*—11*a;*
Figure 13:
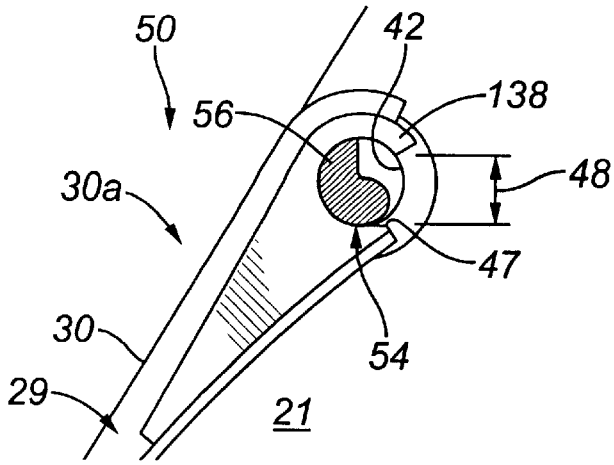
FIG. 13 is a partial cutaway view of the sheave block of FIG. 5 showing a cross section of the cam rod sheave guard lock.

As shown in FIG. 13, each C-shaped eyelet 138 of the side guards 30, 32 includes an opening or break 47 in its circumference, the break 47 having a width 48. Referring to FIGS. 11 and 11*a*, each cam rod 54 includes a cam section 56 having major and minor diameters 66, 68. The major diameter 66 of the cam section 56 is larger than the width 48 of the break 47 in each C-shaped eyelet 138, while the minor diameter 68 is smaller than width 48 of the break 47. To retain side guards 30 or 32 in closed position, the corresponding cam rod 54 is rotated to align the major diameter 66 of the cam portion 56 with the opening 47 of the C-shaped eyelets 138, as shown in FIG. 13. To open side guard 30 or 32, the corresponding cam rod 54 is rotated to align the minor diameter 68 of the cam portion 56 with the openings 47 of the C-shaped eyelets 138. The C-shaped eyelets 38 are then releasable from the corresponding cam rod 54, allowing the upper end 30*a* or 32*a* of the respective side guard 30 or 32 to be moved away from the sheaves 14 and walls 20, 21, opening the side guard 30 or 32.

Figure 12:
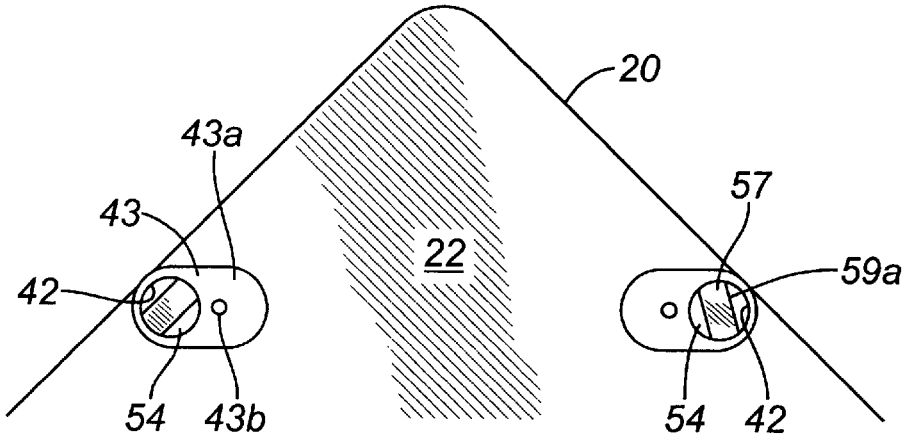
FIG. 12 is an end view of a portion of an alternate embodiment of a sheave block wall made in accordance with the present invention showing a bore and indent.
Figure 14:
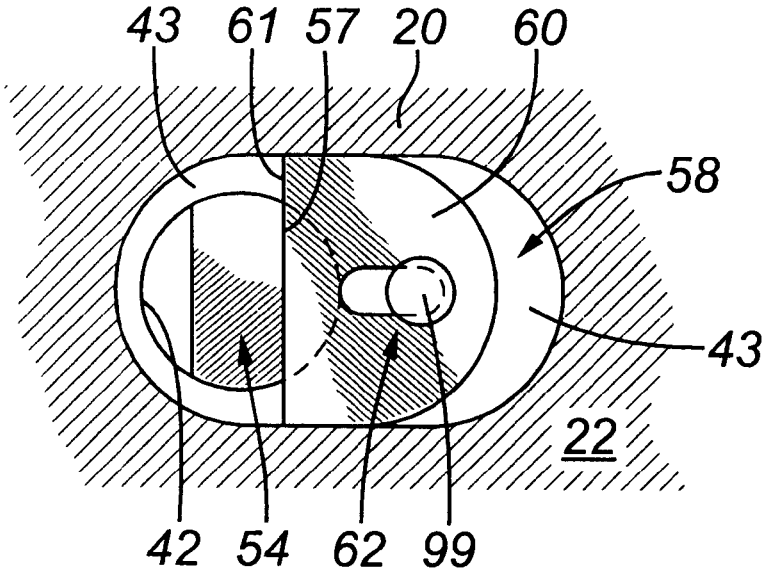
FIG. 14 is an enlarged view of the bore and indent of FIG. 12 and a cam locking plate made in accordance with the present invention.
Figure 15:
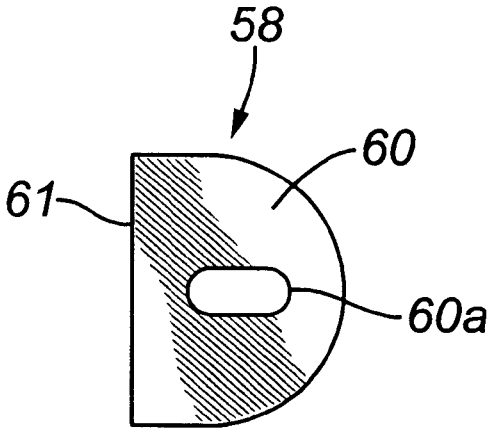
FIG. 15 is a top view of the cam locking plate of FIG. 14.

Referring to FIGS. 14 and 15, a cam lock 58 may be used to hold cam rod 54 in engagement with the C-shaped eyelets 138, thus locking the corresponding side guard 30 or 32 in its closed position. The cam lock 58 may take any suitable form and configuration. The illustrated cam locks 58 for each guard 30, 32 include a cam lock plate 60 slideably disposed within a depression or indent 43 formed in the outer surface 22 of the wall 20 or 21 and surrounding the upper bore 42 (FIG. 12). The indents 43 do not extend through the entire thickness of the wall 20 or 21, as does the bores 42.

The plate 60 is held in the indent 43 by riding in grooves (not shown) or by any other suitable retaining means and is slideable laterally in the indent 43. The plate 60 includes an edge 61 engageable with a ledge 57 extending from the end 59*a* or 59*b* of the cam rod 54. The ledge 57 extends into the indent 43 from the upper bore 42. When the plate 60 is moved laterally away from the cam rod 54 and upper bore 42, the cam rod 54 is free to rotate, allowing opening and closing of the corresponding side guard 30 or 32. When the cam rod 54 is rotated such as described above to retain the corresponding side guard 30 or 32 in a closed position, the plate 60 is movable laterally to engage the edge 61 of the plate 60 with the ledge 57 of the cam rod 54, as shown in FIG. 14. This positioning of the plate 60 prevents the cam rod 54 from rotating, thus locking the corresponding side guard 30 or 32 in its closed position.

Referring to FIGS. 14 and 15, the plate 60 can be secured in one or more lateral positions with the use of a releasable plate lock 62, such as bolt 99. The bolt 99 is rotatable through a bore 60*a* in the plate 60 and engageable with one or more plate lock bores 43*b* in the indent wall 43*a* (FIG. 12). When the plate 50 is aligned over a bore 43*b* in the indent wall 43*a*, the bolt 99 can be tightened to engage the bore 43*b* anchoring the lateral position of the plate 60. It should be understood that any other suitable form of releasable plate lock 62 may be used, and the use of a plate lock is not essential.

Figure 16:
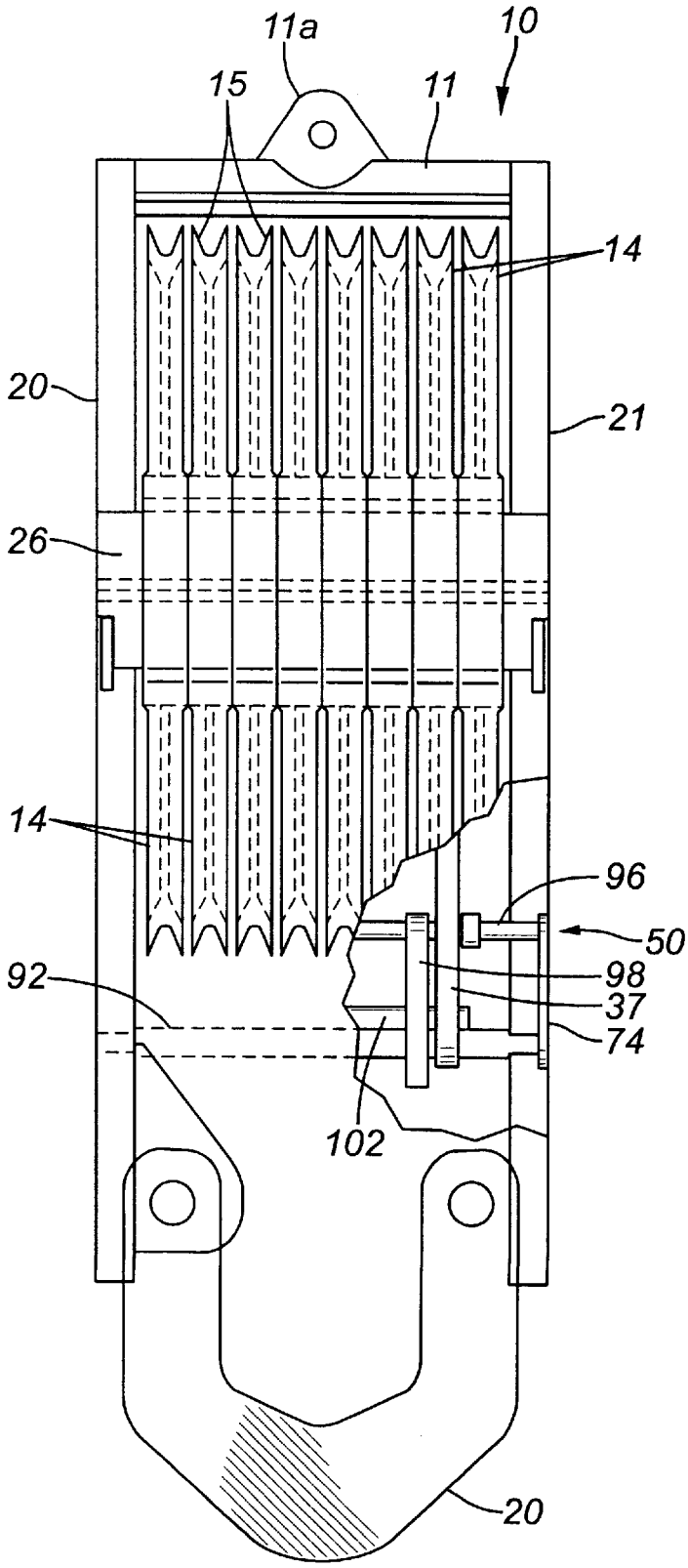
FIG. 16 is a partial cutaway view of a third embodiment of sheave block made in accordance with the present invention showing a coupler.
Figure 17:
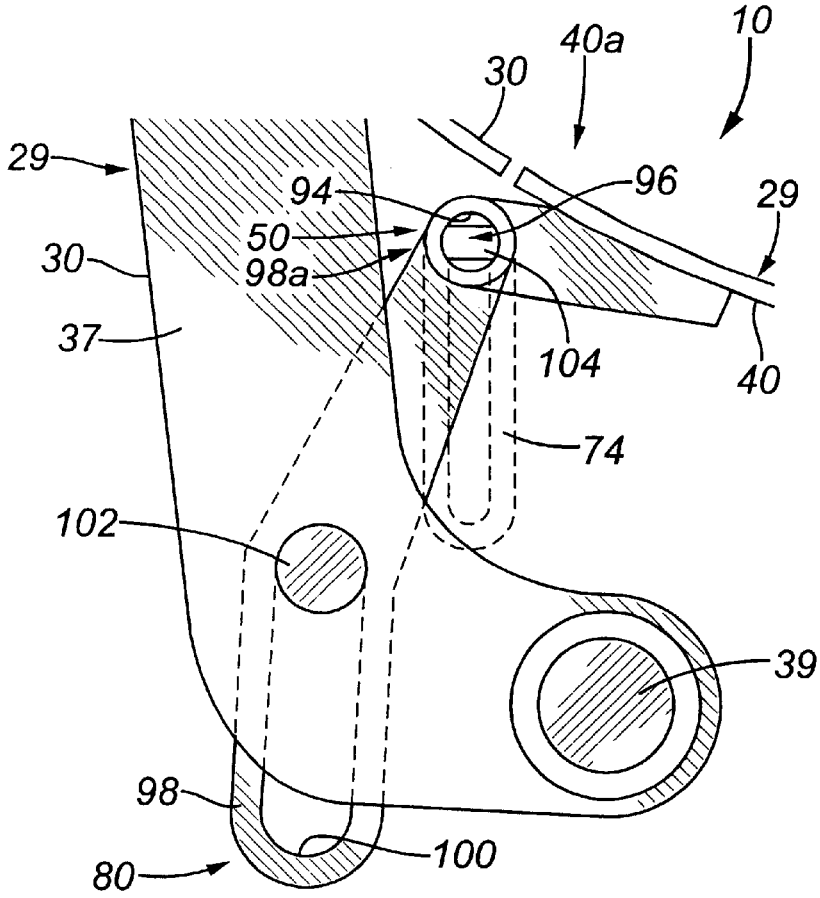
FIG. 17 is an enlarged view of the coupler of FIG. 16.

In yet another embodiment of the present invention, as shown in FIGS. 16 and 17, the guards 29 may be interconnected with a coupler 80 that includes a pair of angled links 98. Each angled link 98 has a laterally extending cut-out 100 engageable over a protrusion, or pin, 102 extending from the curved lug portion 37 of side guard 30 or 32. The pin 102 is moveable upwardly and downwardly within the cut-out 100.

The lower guard 40 includes a hole 94 at each side 40*a*, 40*b* engaged over a guide shaft 96 that extends between walls 20, 21. The guide shaft 96 is moveable upwardly and downwardly at its ends in guide slots 74 of walls 20, 21 similarly as described above with respect to guide pins 72 of FIGS. 1 and 3, allowing opening and closing of the lower guard 40. The guide shaft 96 rotatably engages the upper end 98*a* of the adjacent angled link 98. When the side guard 30 is closed, side 40*a* of the lower guard 40 will be held in its closed position by the angled link 98. Furthermore, side 40*a* of the lower guard 40 cannot be opened unless the side guard 30 is opened. When side guard 30 is opened, guide shaft 96 is moveable downwardly in the guide slot 74, allowing side 40*a* of the lower guard 40 to be opened. Side guard 32 and side 40*b* of the lower guard 40 operate similarly.

Figure 18:
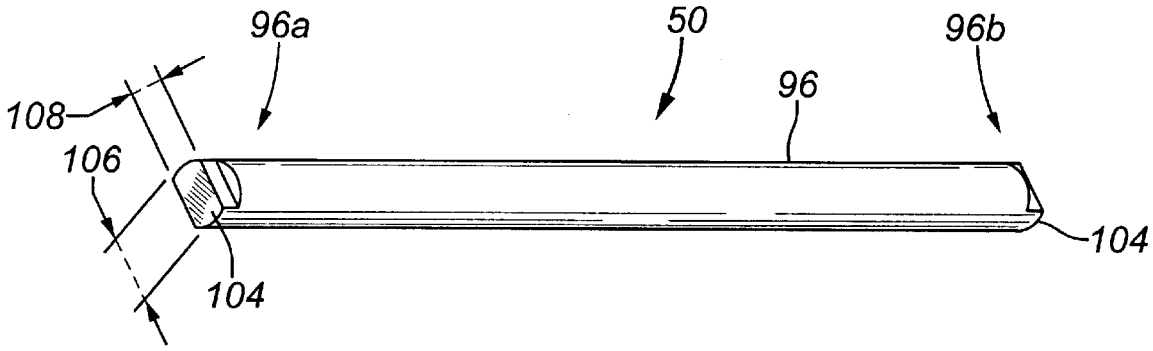
FIG. 18 is an isolated view of the lower guard guide shaft of FIG. 16.
Figure 19:
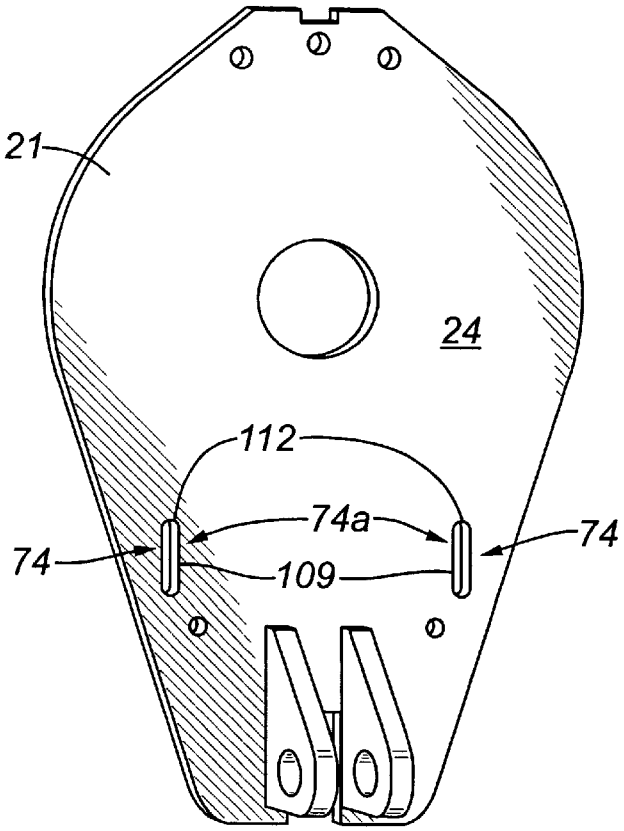
FIG. 19 is a perspective view of a wall of the sheave block of FIG. 16.

Referring to FIGS. 17–19, the lower guard 40 of this embodiment can be configured with a lock, or locks, 50 to retain the lower guard 40 in its closed position even when the side guards 30, 32 are opened. The lock 50 can take any suitable form and configuration. As shown in FIGS. 17 and 18, the guide shaft 96 may function as lock 50. For example, the guide shaft 96 may be rotatable and include a guide extension 104 extending from one, or both of its ends 96*a*, 96*b*, the guide extension 104 being moveable within a guide slot 74.

Figure 17A:
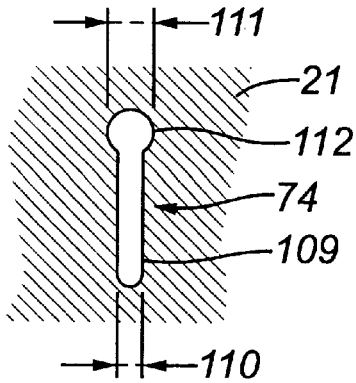
FIG. 17*a* is an isolated view of the guide slot of FIG. 17.

Each guide slot 74 of this embodiment includes a wide portion 112 at its upper end 74*a* (FIG. 17*a*) having a width 111 greater than the width 110 of a downwardly extending slot portion 109 of the guide slot 74. As shown in FIG. 18, each guide extension 104 has a first width 106 and a second width 108. The first width 106 of the guide extension 104 is larger than the width 110 of the guide slot 74, while the second width 108 of the guide extension 104 is smaller than the width 110 of the guide slot 74. Thus, when the guide extension 104 is located within the wide portion 112 of the guide slot 74 and is rotated so that its first width 106 is aligned with the guide slot 74, the guide shaft 96 and the corresponding side 40*a* or 40*b* of the lower guard 40 are held in closed position. When the guide shaft 96 is rotated so that the second width 108 of the guide extension 104 aligns with the guide slot 74, the guide shaft 96 may then be moved downwardly in the guide slot 74, allowing the corresponding side 40*a* or 40*b* of the lower guard 40 to be lowered, or opened. This embodiment further allows each side guard 30 and 32 to be opened independently or along with the corresponding side 40*a*, 40*b* of the lower guard 40.

A method for using a sheave block 10 made in accordance with the present invention will now be described. Referring to FIGS. 1 and 5*a*, the wireline 16 is reeved over, or passed around, one or more sheaves 14 in the sheave block 10. The sheave block 10 is suspended from the wireline 16, which is anchored at its ends to fixed objects (not shown), as is known in the art. To rereeve the wireline 16, tension in the wireline 16 is released, such as by hanging the block 10 at cap eye 11*a* (FIG. 2) from a separate line (not shown) connected with a fixed object, such as a derrick (not shown) of a drilling rig. The sheave guards 29 are unlocked and moved into their open positions such as described above with respect to the preferred embodiments. The guards 29 may be moved between their open and closed positions manually, or with any suitable mechanical, hydraulic, linear or rotational device (not shown), such as a hoist or lever (not shown). The sheaves 14 are then accessible for rereeving of the wireline 16 without having to entirely remove the wireline 16 from the block 10.

In the preferred method, one end (not shown) of the wireline 16 is disconnected from its anchor (not shown) and the free, or loose, end of the wireline 16 is rereeved around the desired number of sheaves 14 in the block 10. For example, the wireline 16 can be rereeved in the block 10 from originally having five reeves 27 to having three reeves 27 by removing the two reeves 27 closest to the loose end of the wireline 16. The remaining three reeves 27 may be moved, or jumped, between sheaves 14 to reposition them within the block 10, such as in the center of the block 10 or any other desired load balanced pattern. The term "jump" and "jumped" as used herein mean moving a reeve 27 of the wireline 16 from one sheave 14 onto another sheave 14 in the block 10. After the wireline 16 is rereeved, the free end of the wireline 16 is then reconnected to its anchor (not shown) and the guards 29 are closed and locked into the closed positions, such as described above.

While preferred embodiments of the present invention have been shown and described, modifications thereof can be made by one skilled in the art without departing from the spirit or teachings of the invention. The embodiments described herein are exemplary only and are not limiting of the invention. Furthermore, each of the foregoing aspects or features, such as, for example, the couplers, locks and retractors, may be combined or may have common components, and may, when included, be used alone or in combination with other such aspects. Many variations and modifications of the embodiments described herein are thus possible and within the scope of the invention. Accordingly, it is to be understood that the scope of protection is not limited to the embodiments described herein.

What is claimed is:

1. A sheave block for use with a wireline and having a plurality of sheave block components, comprising;

first and second opposing walls;

a shaft extending between said first and second opposing walls and having at least two grooved sheaves disposed thereon, each said grooved sheave engageable with the wireline; and at least one retractable sheave guard movably connected to said first and second opposing walls and moveable between open and closed positions, said open position allowing the wireline to be rereeved around at least one of said grooved sheaves without entirely removing the wireline from the sheave block and without having to disassemble significant additional sheave block components.

2. The sheave block of claim 1 wherein at least one said retractable sheave guard is movable between said open and closed positions while the wireline is engaged with at least one said grooved sheave.

3. The sheave block of claim 1 wherein said at least one retractable sheave guard is moveable between said open and closed positions without moving said at least one retractable sheave guard upwardly.

4. The sheave block of claim 1 wherein at least one of said retractable sheave guards is pivotably moveable between said open and closed positions.

5. The sheave block of claim 1 wherein at least one of said retractable sheave guards includes a plurality of fingers and a plurality of wireline passages enabling said retractable sheave guard to be movable between said open and closed positions while the wireline is engaged with at least one said grooved sheave.

6. The sheave block of claim 1 further including at least one releasable lock capable of retaining at least one of said retractable sheave guards in said closed position.

7. The sheave block of claim 6 wherein at least one of said retractable sheave guards includes eyelets engageable with said releasable lock.

8. The sheave block of claim 1 wherein at least two of said retractable sheave guards are connected.

9. The sheave block of claim 8 further including at least one coupler connecting at least two of said retractable sheave guards.

10. The sheave block of claim 9 wherein said coupler includes at least one link.

11. The sheave block of claim 1 wherein at least two of said retractable sheave guards are cooperatively moveable between said open and closed positions.

12. The sheave block of claim 1 further including at least one sheave guard stop member capable of supporting at least one of said retractable sheave guards in said open position.

13. The sheave block of claim 1 wherein a first one of said retractable sheave guards includes first and second ends, and wherein said first retractable sheave guard is moveable downwardly relative to said grooved sheaves from said closed position to said open position.

14. The sheave block of claim 13 wherein said first and second ends of said first retractable sheave guard are independently moveable upwardly and downwardly relative to said at least one grooved sheave.

15. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block; and at least one releasable lock capable of retaining at least one of said retractable sheave guards in said closed position, wherein said releasable lock includes at least one cam rod.

16. A sheave block for use with a wireline comprising;

first and second opposing walls;

a shaft extending between said first and second opposing walls and having at least one grooved sheave disposed thereon each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position; and wherein at least one of said first and second opposing walls includes a guide slot, and wherein said first retractable sheave guard includes at least one guide member moveable upwardly and downwardly within said guide slot.

17. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block; and wherein a first one of said retractable sheave guards includes first and second ends, and wherein said first retractable sheave guard is moveable downwardly relative to said grooved sheaves from said closed position to said open position;

wherein at least one of said first and second opposing walls includes a guide slot, and wherein said first retractable sheave guard includes at least one guide member moveable upwardly and downwardly within said guide slot; wherein said guide member is rotatable and includes a guide portion having a non-circular cross-section, wherein said guide portion is selectively moveable upwardly and downwardly within said guide slot.

18. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position; and wherein a second one of said retractable sheave guards is disposed adjacent said first end of said first retractable sheave guard, and a third one of said retractable sheave guards is disposed adjacent said second end of said first retractable sheave guard.

19. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block; and wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard;

wherein said first retractable sheave guard is connected to said second and third retractable sheave guards.

20. The sheave block of claim 19 wherein said first retractable sheave guard is connected to at least one of said second and third retractable sheave guards with at least one coupler, said coupler including a first end engageable with said first retractable sheave guard and a laterally extending cut-out, wherein at least one of said second and third retractable sheave guards includes a lower curved portion, said lower curved portion having a protrusion moveable within said laterally extending cut-out.

21. The sheave block of claim 20 wherein said first end of said coupler is connected with said first retractable sheave guard with a cam rod, said cam rod further engageable with an opening in at least one of said opposing walls and being capable of at least partially securing said first retractable sheave guard in said closed position.

22. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard; wherein said first retractable sheave guard is connected to said second and third retractable sheave guards; and at least one coupler connecting said first retractable sheave guard to said second and third retractable sheave guards.

23. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard; wherein said first retractable sheave guard is connected to said second and third retractable sheave guards; and at least one coupler connecting said first retractable sheave guard to said second and third retractable sheave guards, wherein said coupler includes at least one link.

24. A sheave block for use with a wireline comprising;

first and second opposing walls;

a shaft extending between said first and second opposing walls and having at least one grooved sheave disposed thereon, each said grooved sheave engageable with the wireline; and at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard;

wherein said first, second and third retractable sheave guards are cooperatively moveable between said open and closed positions.

25. A sheave block for use with a wireline comprising;

first and second opposing walls;

a shaft extending between said first and second opposing walls and having at least one grooved sheave disposed thereon, each said grooved sheave engageable with the wireline; and at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard;

wherein said first, second and third retractable sheave guards are independently moveable relative to one another between said open and closed positions.

26. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard; and at least one releasable lock capable of retaining said first, second and third retractable sheave guards in said closed positions.

27. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard; and at least one releasable lock capable of retaining said first, second and third retractable sheave guards in said closed positions, wherein said releasable lock includes at least one cam rod.

28. A sheave block for use with a wireline comprising;

first and second opposing walls;

a shaft extending between said first and second opposing walls and having at least one grooved sheave disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard; and at least one releasable lock capable of retaining said first, second and third retractable sheave guards in said closed positions; wherein said releasable lock includes a first rotatable cam rod engageable with said second retractable sheave guard, and a second rotatable cam rod engageable with said third retractable sheave guard.

29. The sheave block of claim 28 wherein each of said second and third retractable sheave guards includes at least one C-shaped eyelet engageable with said first and second rotatable cam rods, respectively.

30. The sheave block of claim 29 further including at least a third rotatable cam rod engageable with said first retractable sheave guard.

31. A sheave block for use with a wireline comprising;

first and second opposing walls;

a shaft extending between said first and second opposing walls and having at least one grooved sheave disposed thereon, each said grooved sheave engageable with the wireline; and at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard;

wherein each of said second and third retractable sheave guards includes a plurality of fingers and a plurality of wireline passages enabling said retractable sheave guards to be movable between said open and closed positions while the wireline is engaged with at least one said grooved sheave.

32. A sheave block for use with a wireline comprising;

first and second opposing walls;

a shaft extending between said first and second opposing walls and having at least one grooved sheave disposed thereon, each said grooved sheave engageable with the wireline; and at least one retractable sheave guard movably connected to said first and second opposing walls and moveable between open and closed positions, said open position allowing the wireline to be rereeved around at least one of said grooved sheaves without entirely removing the wireline from the sheave block;

wherein a first one of said retractable sheave guards includes first and second ends, and wherein said first retractable sheave guard is moveable downwardly relative to said grooved sheaves from said closed position to said open position;

wherein a second one of said retractable sheave guards is disposed adjacent said first end of said first retractable sheave guard, and a third one of said retractable sheave guards is disposed adjacent said second end of said first retractable sheave guard;

wherein said second and third retractable sheave guards are pivotably movable between said open and closed positions.

33. A sheave block having a housing containing a plurality of sheaves engageable with a wireline comprising;

first and second side sheave guards moveably connected with the housing; and a lower sheave guard movably connected with the housing, said lower sheave guard disposed between said first and second side sheave guards;

wherein each said sheave guard is moveable between an open and a closed position, wherein at least a portion of each said sheave guard is farther from the sheaves when said sheave guard is in said open position than when said sheave guard is in said closed position.

34. The sheave block of claim 33 wherein said sheave guards are movable between said open and closed positions while the wireline is engaged with at least one of the sheaves.

35. The sheave block of claim 34 wherein the wireline may be rereeved around at least one of said grooved sheaves without entirely removing the wireline from the sheave block.

36. The sheave block of claim 33 wherein said sheave guards are moveable between said open and closed positions without moving said sheave guards upwardly.

37. The sheave block of claim 33 wherein said lower sheave guard includes first and second ends, and wherein said lower sheave guard is moveable downwardly relative to the sheaves from said closed position to said open position of said lower sheave guard.

38. The sheave block of claim 33 wherein the housing includes at least two guide slots, and wherein said lower sheave guard includes at least two guide members, each said guide member moveable upwardly and downwardly within one of said guide slots.

39. The sheave block of claim 38 wherein at least one said guide member is rotatable and includes a guide portion having a non-circular cross-section, wherein said guide portion is selectively moveable upwardly and downwardly within one of the guide slots.

40. The sheave block of claim 33 wherein said lower sheave guard is connected to said first and second side sheave guards.

41. The sheave block of claim 40 further including at least one coupler connecting said lower sheave guard to said first and second side sheave guards.

42. The sheave block of claim 41 wherein said coupler includes at least one link.

43. The sheave block of claim 33 wherein said first and second side sheave guards and said lower sheave guard are cooperatively moveable between said open and closed positions.

44. The sheave block of claim 33 wherein said first and second side sheave guards and said lower sheave guard are independently moveable between said open and closed positions.

45. The sheave block of claim 33 further including at least one releasable lock capable of retaining said sheave guards in said closed positions.

46. The sheave block of claim 45 wherein said releasable lock includes at least one cam rod.

47. The sheave block of claim 45 wherein said releasable lock includes a first rotatable cam rod engageable with said first side sheave guard, and a second rotatable cam rod engageable with said second side sheave guard.

48. The sheave block of claim 33 wherein each of said first and second side sheave guards includes a plurality of fingers and a plurality of wireline passages enabling each said side sheave guard to be movable between said open and closed positions while the wireline is engaged with at least one of the plurality of sheaves.

49. The sheave block of claim 33 further including at least one sheave guard stop member capable of supporting at least one of said sheave guards in said open position.

50. A sheave block for use with a wireline comprising;

first and second opposing walls;

a shaft extending between said first and second opposing walls and having at least two grooved sheaves disposed thereon, each said grooved sheave engageable with the wireline;

a plurality of retractable sheave guards movably connected to said first and second opposing walls;

means for connecting said retractable sheave guards to said first and second opposing walls, wherein said retractable sheave guards are capable of being moved between open and closed positions while the wireline is engaged over at least one of said grooved sheaves, and wherein at least one said retractable sheave guard is capable of preventing a wireline engaged upon at least one said grooved sheave from moving to another said grooved sheave when said at least one retractable sheave guard is in said closed position; and means for guiding said retractable sheave guards between open and closed positions.

51. The sheave block of claim 50 further including means for connecting said retractable sheave guards together.

52. A method of rereeving a wireline through a sheave block without having to completely remove the wireline from the sheave block, the sheave block having a plurality of sheaves, at least three retractable sheave guards movable between open and closed positions, and at least one releasable sheave guard lock capable of securing at least one retractable sheave guard in the closed position, the wireline passing through the sheave block and being reeved over at least one sheave in the sheave block comprising:

releasing at least one sheave guard lock;

moving at least three retractable sheave guards into open positions independent of the wireline;

moving a free end of the wireline through the sheave block to change the number of reeves of the wireline over the sheaves in the sheave block;

moving at least one retractable sheave guard into a closed position; and engaging the sheave guard lock.

53. The method of claim 52 further including moving at least one reeve of the wireline from one sheave to another sheave in the sheave block.

54. The method of claim 52 wherein the sheave block has a plurality of retractable sheave guards, further including moving each retractable sheave guard into an open position independent of the wireline, and moving each retractable sheave guard into a closed position.

55. A sheave block for use with a wireline comprising;

first and second opposing walls;

a shaft extending between said first and second opposing walls and having at least two grooved sheaves disposed thereon, each said grooved sheave engageable with the wireline;

at least one retractable sheave guard movably connected to said first and second opposing walls and moveable between open and closed positions, said open position allowing the wireline to be rereeved around at least one of said grooved sheaves without entirely removing the wireline from the sheave block; and at least one releasable lock capable of retaining at least one of said retractable sheave guards in said closed position, said releasable lock including at least one cam rod.

56. The sheave block of claim 55 wherein said at least one cam rod includes at least first, second and third cam rods, and wherein said at least one retractable sheave guards includes at least first, second and third retractable sheave guards, said first cam rod being engageable with said first retractable sheave guard, said second cam rod being engageable with said second retractable sheave guard and said third cam rod being engageable with said third retractable sheave guard.

57. The sheave block of claim 56 wherein each of said second and third retractable sheave guards includes at least one C-shaped eyelet engageable with said second and third cam rods, respectively.

58. The sheave block of claim 55 wherein at least two of said retractable sheave guards are cooperatively moveable from said open positions to said closed positions.

59. The sheave block of claim 55 and wherein said at least one retractable sheave guards includes at least first, second and third retractable sheave guards, said first retractable sheave guard disposed between said second and third retractable sheave guards, wherein said first said retractable sheave guard is connected to at least one of said second and third retractable sheave guards with at least one coupler, said coupler including a first end engageable with said first retractable sheave guard and a laterally extending cut-out, wherein at least one of said second and third retractable sheave guards includes a lower curved portion, said lower curved portion having a protrusion moveable within said laterally extending cut-out.

60. A sheave block for use with a wireline comprising;

first and second opposing walls;

a shaft extending between said first and second opposing walls and having at least two grooved sheaves disposed thereon, each said grooved sheave capable of engagement with the wireline; and at least one retractable sheave guard movably connected to said first and second opposing walls and moveable between open and closed positions, wherein at least one said retractable sheave guard is capable of preventing a wireline engaged with at least one of said grooved sheaves from disengaging from said at least one grooved sheave when said retractable sheave guard is in said closed position.

61. The sheave block of claim 60 wherein a first said retractable sheave guard is disposed between a second and a third said retractable sheave guard, said first retractable sheave guard being connected to at least one of said second and third retractable sheave guards with at least one coupler, said coupler including a first end engageable with said first retractable sheave guard and a laterally extending cut-out, wherein at least one of said second and third retractable sheave guards includes a lower curved portion, said lower curved portion having a protrusion moveable within said laterally extending cut-out.

62. The sheave block of claim 61 wherein said first end of said coupler is connected with said first retractable sheave guard with a cam rod, said cam rod further engageable with an opening in at least one of said opposing walls and being capable of at least partially securing said first retractable sheave guard in said closed position.

63. The sheave block of claim 61 further including at least one releasable lock capable of retaining at least one of said retractable sheave guards in said closed position, said releasable lock including at least one cam rod.

64. The sheave block of claim 63 wherein each of said second and third retractable sheave guards includes at least one C-shaped eyelet engageable with a first and a second said cam rod, respectively.

65. The sheave block of claim 64 further including at least a third rotatable cam rod engageable with said first retractable sheave guard.

66. The sheave block of claim 61 wherein the wireline may be rereeved around at least one of said grooved sheaves without entirely removing the wireline from the sheave block.

67. The sheave block of claim 66 wherein at least two of said retractable sheave guards are cooperatively moveable from said open positions to said closed positions.

68. The sheave block of claim 66 wherein said at least one retractable sheave guards includes at least three retractable sheave guards.

69. A retractable lower sheave guard device for use with a sheave block, the sheave block including first and second opposing walls, at least one grooved sheave disposed on a shaft extending between the opposing walls and at least one retractable side sheave guard, the grooved sheave capable of engaging a wireline, comprising:

a curved guard portion movably connected with the first and second opposing walls of the sheave block, said curved guard portion movable between an open position and a closed position, wherein said curved guard portion is capable of preventing a wireline disposed on at least one grooved sheave in the sheave block from disengaging the grooved sheave when said curved guard portion is in said closed position, further wherein said curved guard portion is capable of allowing the wireline to be rereeved around at least one of said grooved sheaves without entirely removing the wireline from the sheave block; and at least one connector engageable with said curved guard portion and the at least one retractable side sheave guard; and at least one lock associated with the sheave block and capable of maintaining said curved guard portion in said closed position.

* * * * *